United States Patent [19]

Witherspoon

[11] 4,092,898

[45] June 6, 1978

[54] SHOCK-EXCURSION APPARATUS FOR RETRACTING THE UMBILICAL PLUG OF A MISSILE

[75] Inventor: John F. Witherspoon, Mountain View, Calif.

[73] Assignee: The United States of America as represented by the Secretary of the Navy, Washington, D.C.

[21] Appl. No.: 790,511

[22] Filed: Apr. 25, 1977

[51] Int. Cl.[2] ..... F41F 3/04

[52] U.S. Cl. ..... 89/1.811

[58] Field of Search ..... 89/1.811, 1.8; 339/45 R

[56] References Cited

U.S. PATENT DOCUMENTS

| | | | |
|---|---|---|---|
| 3,224,335 | 12/1965 | Witherspoon et al. | 89/1.811 |
| 3,444,779 | 5/1969 | Buell et al. | 89/1.811 |
| 3,490,331 | 1/1970 | Schimmeyer | 89/1.811 |
| 3,518,613 | 6/1970 | Alpert | 89/1.811 X |
| 3,627,941 | 12/1971 | Wrathall | 89/1.811 X |

*Primary Examiner*—David H. Brown

*Attorney, Agent, or Firm*—Richard S. Sciascia; Paul N. Critchlow

[57] ABSTRACT

A flexible wire is secured at one end to the umbilical plug and at the other to a sheave of a rotary actuator. The actuator is driven by launch-gas pressure to reel in the wire and retract the plug. A plug stop is mounted on the launch tube in the path of travel of the plug. Lift-off of the missile carries the plug into the stop to disengage and free it for retraction. The flexible wire coupling is provided with a slack portion to accommodate shock excursions and assure disengagement of the plug prior to retraction.

6 Claims, 5 Drawing Figures

Fig. 3.
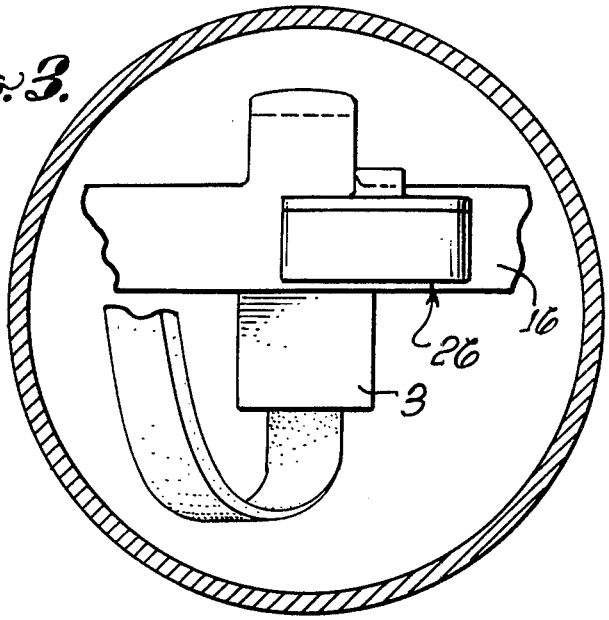
Fig. 5.
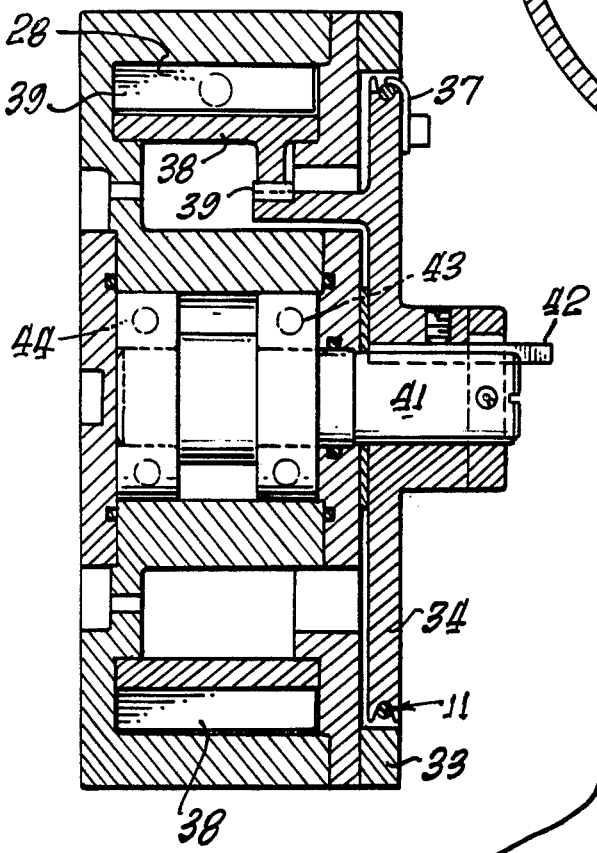
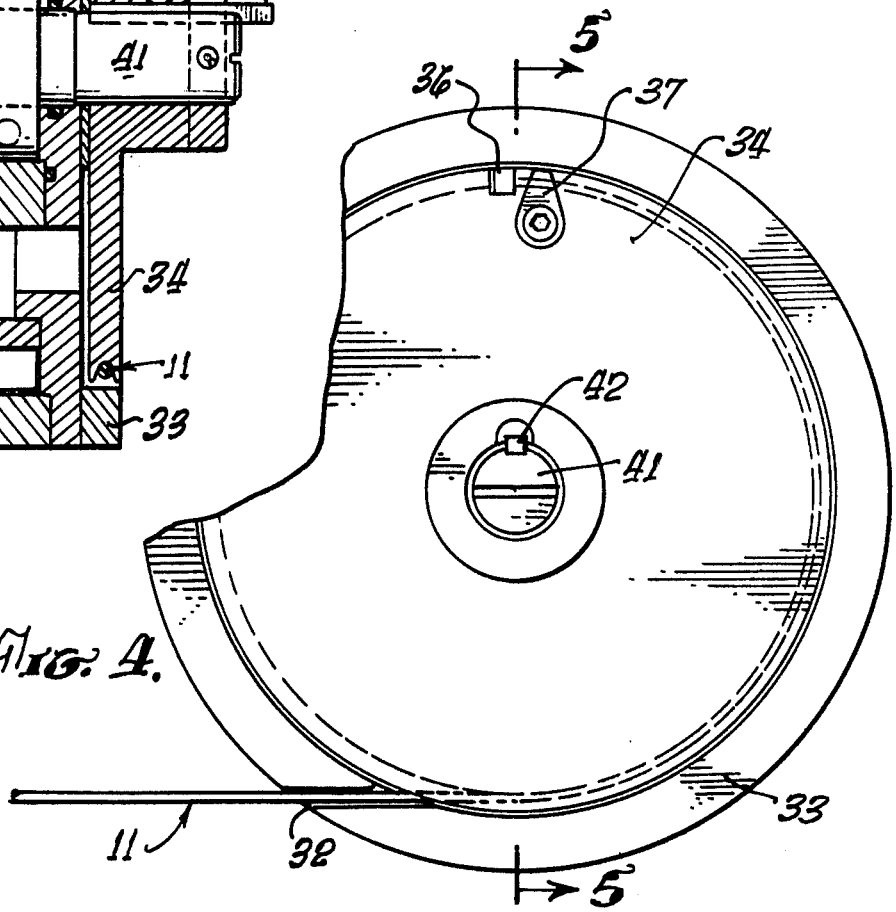
Fig. 4.

SHOCK-EXCURSION APPARATUS FOR RETRACTING THE UMBILICAL PLUG OF A MISSILE

BACKGROUND OF THE INVENTION

The invention relates to umbilical plug retract mechanisms and, in particular, to retract mechanisms capable of protectively accomodating large shock excursions.

As is known, missiles such as those launched from submarines, customarily are carried in launching tubes or the like from which they are fired or launched by motors which generate launch-gas pressure. In conventional systems, the missles are supplied with electrical power both prior to and during their initial lift-off and, for this purpose, so-called umbilical plugs, physically connected to the missiles, carry the power. At a proper time, retract mechanisms are employed to disengage the plugs and draw them away from the rising A difficult design problem for any shipboard launching system arises because of the need to protect the missiles from being damaged by underwater explosions or other like forces which, for example, may occur during an attack. Specifically, the ship's hull, in responding to the explosive force, must be allowed to move a certain distance without imparting its force to the missile. Such movements are known as shock excursions against which the missile must be effectively isolated.

The use of umbilical retract mechanisms creates a special shock excursion problem since these mechanisms not only are mounted in close proximity to the missile but also are physically connected to it through the plug itself and, unless precautions are taken, the connections can transmit the forces to the missile. In early designs, umbilical retract mechanisms were attached to a shock-isolated structure surrounding the missile and therefore did not have to accomodate shock excursions. In more recent designs, however, they are so mounted that the external shock force can be applied through their physical coupling. Also, these mechanisms generally have been composed of relatively rigid elements which, to minimize shock loading, have been designed either to slide, pivot or telescope in manners so as to absorb or accomodate a applied forces. With the larger excursions presently anticipated, they had to grow in size with the corresponding increase in the effective mass to be accomodated. The increased size itself produces problems particularly in submarine applications where space is at a premium.

It is therefore an object of the present invention to provide an umbilical retract mechanism capable of accomodating large shock excursions and of minimizing shock loading by the retract mechanism on the missile.

Another object is to provide such a retract mechanism which has an unusually small size and mass.

Other objects are to provide simpler and more compact mechanisms which requires less adjustment and which accomodate larger shock excursions then previously permitted.

In general, the invention utilizes a flexible wire as a retract mechanism. The wire is attached at one end to the missile and at the other to a moveable member which is driven by the launch-gas pressure of the blast-off in a direction capable of exerting a pulling force on the wire for retracting the plug. The arrangement further includes a stop member mounted on the launch tube in the path of travel of the plug for initially disengaging the plug to permit its retraction. The flexible line is provided with a slack or catenary portion to accomodate shock excursions and to assure that the plug is disengaged prior to its retraction.

BRIEF DESCRIPTION OF THE DRAWINGS

The invention is illustrated in the accompanying drawings of which:

FIG. 3 is a section taken along lines 3—3 of FIG. 2;

FIG. 4 is an end view of a rotary actuator mechanism used in the FIG. 2 mechanism, and FIG. 5 is a section taken along lines 5—5 of FIG. 4.

DETAILED DESCRIPTION OF THE INVENTION

Figure 1:
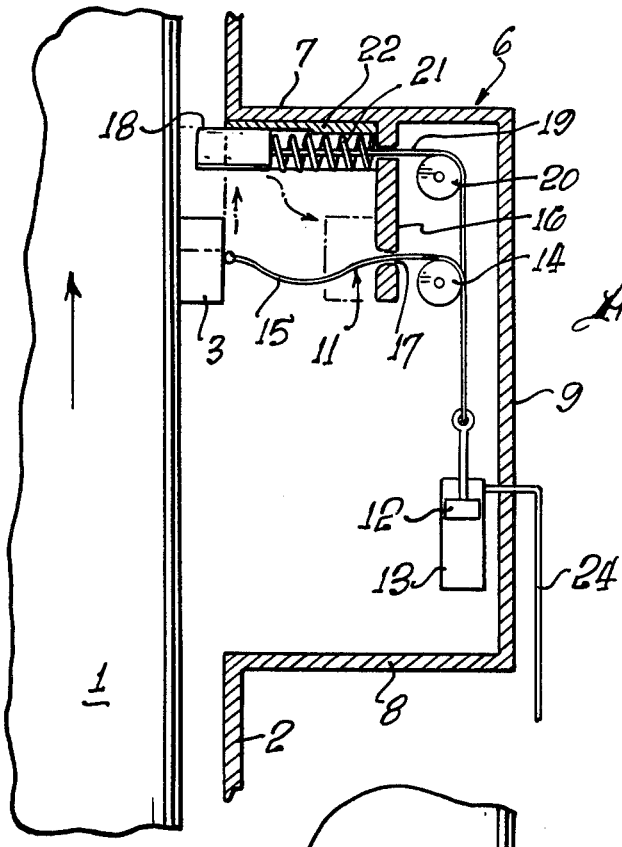
FIG. 1 is a somewhat schematic illustration of one form of the retract mechanism showing the present mechanism mounted in a launch tube housing.

Referring to FIG. 1, the illustrated arrangement includes a missile 1 mounted in firing position in a launcher tube 2 which, in the usual manner, can be considered as a cylindrical tube from which the missile is launched in the direction indicated by the arrow. The missile itself also can be considered as having a rocket motor or the like which, when fired, produces the launch-gas pressure for lift-off.

In conventional systems, it is necessary to supply electrical power to the missile during a period of time immediately prior to its firing as well as for a limited period of time during its initial lift-off. For this purpose, a conventional umbilical plug 3 is physically coupled to the missile and, of course, connected externally to the tube to a power source. Plug 3 can be of any conventional type which, in manners known to the art, plugs into the missile for establishing both the physical and electrical connection. Also, according to conventional practice, the plug may incorporate a latching type of mechanism which prevents accidental disengagement until the latching mechanism is released by a trigger signal. In the illustrated arrangement, such mechanisms can be assumed although their presence is not considered significant insofar as the principles of the invention are concerned.

A principal feature is the provision of a special type of an umbilical plug retract mechanism which, as already indicated, is relatively light, small and, in particular, one that is capable of protecting the missile from the imposition of shock loading forces. As shown, the retract mechanism is mounted in a housing 6 formed in a side wall of launch tube 2 and, for descriptive purposes, the housing can be considered as having upper and lower wall extents 7 and 8 and an inner end wall 9. FIG. 1, as will be recognized, is rather schematic and primarily illustrates present operative principles. As shown, the mechanism includes a flexible wire 11 which may be of a cable or rope-like structure secured at one end to umbilical plug 3 and at its other to a piston 12 mounted in a cylinder 13. The wire rope has a horizontal portion extending inwardly of the housing where it passes over a sheave 14 carried by the housing. A guide block 16 also carried by the housing is provided with an aperture 17 through which the wire rope extends. The horizontal extent of the wire between the plug and aperture 14 is provided with a slack or catenary portion 15 for purposes to be described.

Also mounted in housing 6 is an umbilical plug stop member 18 coupled by a flexible wire rope 19 to piston 12 and passes over another sheave 20. Guide block 16 is apertured as shown to lead the rope or cable onto sheave 20 and a coil spring 21 is mounted between stop member 18 and guide block 16 to normally urge the stop member into its outer, operative disposition. In this operative disposition, stop member 18 is disposed above and directly in the path of travel of plug 3 as the plug is being carried by the missile during lift-off. The function of block 18 is to physically disengage plug 3 to permit its retraction. The lift-off movement of the missile provides the force needed for the disengagement.

Spring 21 is part of a retract arrangement for stop member 18. The need for retracting stop member 18 depends primarily upon whether or not the stop member in its operative position also is in the path of other portions of the missile as it is being launched out of tube 2. For example, some missiles are formed with stepped diameters which may make it necessary to retract stop member 18 and to provide clearance for their passage. To permit the retraction, stop member 18 is slidably mounted in a special housing 22 which is fitted to stop member 18 and the sliding movement may be facilitated by the use of rollers or ball bearings. Wire rope or cable 19 retracts stop member 18 against the outward pressure of spring 21 which, of course, subsequently returns the stop to its operative disposition.

A further feature of the retract mechanism is that launch-gas pressure is used to retractably reel in both line 11 of plug 3 and line 19 of the stop member. For this purpose, a launch-gas pressure line 24 communicates cylinder 13 with the bottom end of launch tube 2 in which the launch-gas pressure builds up when the missile is launched. Operationally considered, when the missile is fired, the gradual pressure build-up in the tube is applied through line 24 to piston 12. When it reaches a predetermined point the pressure moves the piston downwardly in the cylinder to exert a pulling force on the flexible wire ropes coupled to it. To prevent any premature pulling force on umbilical plug 3, slack 17 of wire rope 11 can be of sufficient length so that any initial movement of piston 13 functions to take up the slack rather than exert a pulling force on the plug itself. Alternatively, piston 12 itself can be resiliently held in its upper disposition until a particular pressure build-up has been reached. In this regard, it will be noted that the timing or sequence of events required for retraction of the plug should be such that the missile moves upwardly in its launching direction a sufficient amount to produce its disengagement by stop member 18 prior to the application of the pulling force exerted by the downward launch-gas pressure on piston 12. This sequence of events, however, can be readily controlled particularly because of the relatively slow build-up of the launch-gas pressure and also because, normally, the plug is latched in its missile-engaging position.

Another advantage provided by catenary or slack 17 of the wire rope 11 is that the slack is instrumental in accomodating large shock excursions produced by underwater explosions or the like. Thus, any force tending to move the launching tube away from the missile is accomodated by the presence of the slack. Shock forces applied in other directions also are minimized by the use of flexible wire rope 11 which, in contrast to retract mechanisms having relatively rigid elements or components, is incapable of transmitting shock to the missile primarily because of its flexible nature. Shock forces producing upward or downward movements of the tube relative to the missile are accomodated by providing adequate dimensional spacing between the stop member and the plug as well as the spacing between the plug and the lower wall of housing 6. In general, the flexible wire rope arrangement, with its slack accomodates very large shock excursions and, with its small mass, minimizes any shock loading. The use of launch-gas pressure to drive the retract mechanism provides an unusually simple, reliable and effective motive force arrangement which can be readily controlled.

Figure 2:
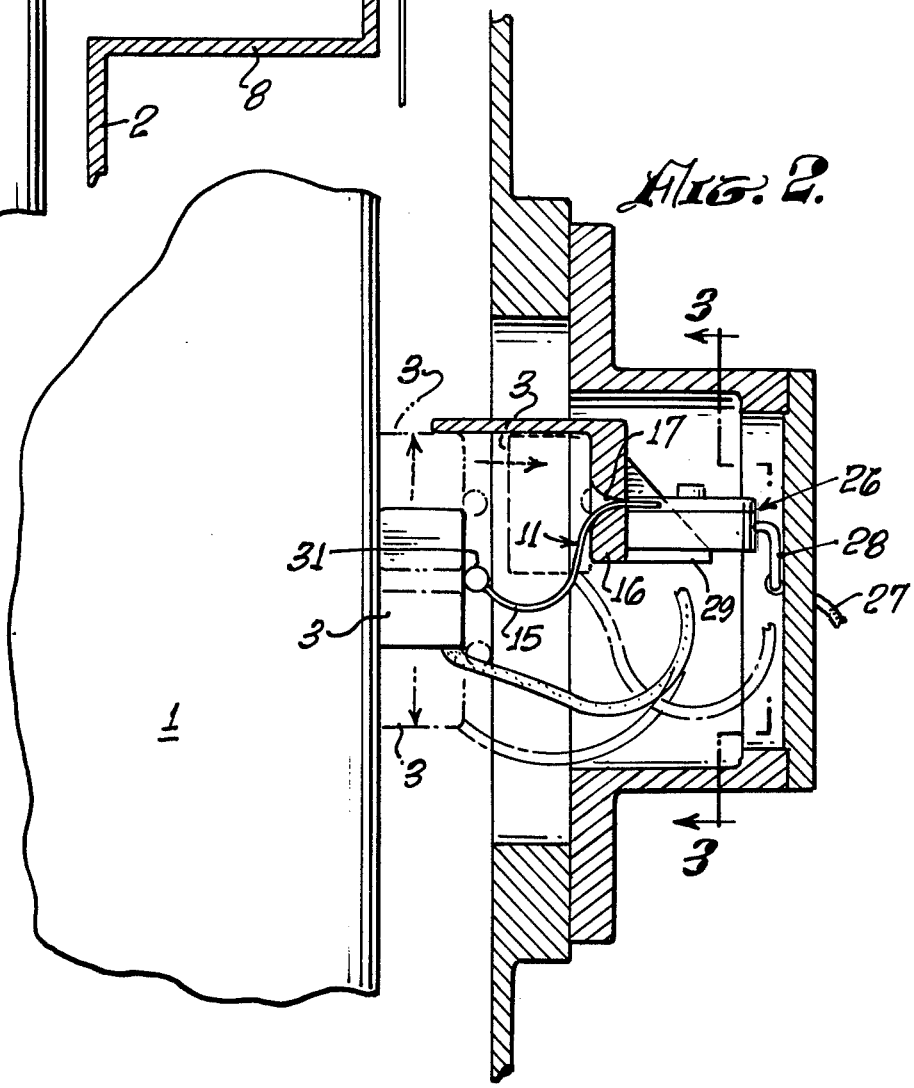
FIG. 2 is a section similar to FIG. 1 showing another form of the retract mechanism.

The remaining Figures of the drawings illustrate a statically-balanced rotary actuator which can be substituted for the cylinder and piston arrangement of FIG. 1. The actuator is preferred because it is significantly less sensitive to shock and vibration. As shown in FIG. 2, rotary actuator 26 is mounted on the previously-mentioned guide block 16 which, in this instance, also carries a stop member 18 fixedly held in its operative position. If desired, however, the stop can be slidably mounted for retraction by the rotary actuator. To drive the actuator, it is supplied with launch pressure gas through a line 27 entering housing 6 through a rear wall and coupled into the actuator by a short length of conduit 28. Physically considered, the acutator is supported by a plate 29 carried by guide block 16. In a manner similar to the FIG. 1 arrangement, plug 3 is coupled to actuator 26 by flexible line 11 which again is provided with a slack or catenary 15. The manner in which flexible line 11 is coupled to the plug is entirely optional. As shown, it is connected by a circular plug 31 received in a suitable pocket (not shown) in the plug.

The operation of the actuator is most apparent in FIG. 4 where it is seen that flexible line 11 is received in an aperture 32 of a shroud member 33 and, interiorly of the shroud, line 11 is wrapped around a rotatably driven sheave 34 with the end portion of the line secured to a block 36. A flanged member 37 holds the wire in position on the sheave.

The structure of rotary actuator 26 is shown in FIG. 5 where it can be noted that sheave 34 is rotatably driven by a rotary vane 38 to which it is connected by a coupling 39. Rotary vane 38 is driven by launch-gas pressure applied through conduit 28 which connects to the launch tube by means of conduit 27 (FIG. 2). A stationary vane 39 also is mounted within the actuator and the rotary vane is driven from a so-called cocked position to the stationary vane. Rotation of the rotary vane drives a shaft 41 which journals the sheave and to which the sheave is rotatably coupled by means of a key 42. Key 42 is manually retractable so that it can be removed to permit the actuator to be reset after it has accomplished its function. Shaft 41 is mounted on ball bearings 43 and also on a combination backstop, clutch and ball bearing 44. Essentially, member 44 is a Sprag coupling primarily employed as a clutch. As is known, these couplings are of a type of a spring mechanism or the like which rotates freely in one direction but functions to bind and stop rotary movement in the reverse direction. The particular member used in the illustrated embodiment is known as a 'Cam Clutch' commercially marketed as model D-205 of the Morse Chain Co. The precise structural arrangement of the rotary actuator is not of critical importance in the present invention and obviously can be varied to suit other purposes. Essentially, the actuator is employed because of its relative insensitivity to shock and vibration and these advantages are provided by the stable mounting of a launch-gas pressure driven rotary vane and by the use of the sheave which is securely mounted on its rotary shaft. The use of a backstop type of clutch also is helpful in that is prevents rebound of the plug towards the missile. Also, it permits reeling in of the flexible wire rope but prevents paying it out. Any type of rotary actuator capable of achieving these functions can be used to advantage.

It is believed that the structure and operation of the present retract mechanism should be clear from the preceding description. Obviously many modifications and variations of the present invention are possible in the light of the above teachings. It is therefore to be understood that within the scope of the appended claims the invention may be practiced otherwise than as specifically described.

I claim:

1. For use with a launch-gas powered missile having an umbilical plug separably coupled into its side wall and electrical power conduit coupled to the plug; apparatus for physically disengaging and retracting said plug during the initial launching movement of the missile from its launching tube comprising:

a plug-disengaging stop member carried by said launching tube in the path of travel of the plug for forcefully disengaging the plug during missile lift-off, a flexible line secured at one end to said plug, a launch-gas driven retract means having a driven member secured to the other end of the line, and conduit means for applying said launch-gas pressure to said driven member for moving it in a line-pulling direction whereby said disengaged plug is retracted, said flexible line being provided with a catenary for accomodating shock excursions of said launching tube relative to said missile and for assuring plug disengagement prior to said retraction.

2. The apparatus of claim 1 wherein said retract means includes:

a cylinder, and a piston reciprocably mounted in the cylinder, said flexible line being coupled to said piston and said conduit means being communicated with said cylinder for driving said piston in said line-pulling direction.

3. The apparatus of claim 2 wherein said plug stop member is slidably mounted for retractable movement into said housing out of said path of travel of said plug, said apparatus further including:

a second flexible line coupled at one end to said piston and at the other to said plug stop member.

4. The apparatus of claim 1 wherein said retract means is a rotary actuator.

5. The apparatus of claim 4 wherein said rotary actuator includes:

a rotatably-driven sheave coupled to said flexible line, and vane means for driving said sheave, said conduit means applying said launch-gas pressure to said vane means.

6. The apparatus of claim 5 further including:

shaft means for said sheave, and keying means for rotatably connecting said shaft and sheave means, said keying means being removably mounted in a splined interconnection for permitting independent rotational movement of said sheave relative to said shaft means.

* * * * *